US009388616B2

(12) United States Patent
Cooper et al.

(10) Patent No.: US 9,388,616 B2
(45) Date of Patent: Jul. 12, 2016

(54) HINGE COVER AND METHOD OF USE

(71) Applicant: Hardware Resources, Inc., Bossier City, LA (US)

(72) Inventors: Rachel Cooper, Farmers Branch, TX (US); Travis McElveen, Bossier City, LA (US); Dennis McGregor, Farmers Branch, TX (US)

(73) Assignee: HARDWARE RESOURCES, INC., Bossier City, LA (US)

( * ) Notice: Subject to any disclaimer, the term of this patent is extended or adjusted under 35 U.S.C. 154(b) by 18 days.

(21) Appl. No.: 14/254,438

(22) Filed: Apr. 16, 2014

(65) Prior Publication Data

US 2015/0300065 A1 Oct. 22, 2015

(51) Int. Cl.
*E05D 11/00* (2006.01)
*E05D 11/06* (2006.01)

(52) U.S. Cl.
CPC ..... *E05D 11/0054* (2013.01); *E05D 11/06* (2013.01); *Y10T 16/533* (2015.01); *Y10T 16/5335* (2015.01)

(58) Field of Classification Search
CPC ..... E05D 3/142; E05D 11/0054; E05D 2011/0072; Y10T 16/533; Y10T 16/5335; Y10T 16/5401; Y10S 16/14
See application file for complete search history.

(56) References Cited

U.S. PATENT DOCUMENTS 4,359,802 A 11/1982 Rock
D268,893 S 5/1983 Salice
4,847,948 A 7/1989 Gross et al.
4,856,141 A * 8/1989 Sassenberg ..... E05D 5/08 16/250
4,870,716 A 10/1989 Grass
D309,247 S * 7/1990 Grass ..... D8/323
D309,704 S 8/1990 Grass
5,056,192 A 10/1991 Grass
5,085,491 A 2/1992 Lautenschlager
5,210,907 A 5/1993 Toyama (Continued)

FOREIGN PATENT DOCUMENTS

CA D 63111 5/1989
CA D 73907 2/1994

(Continued)

OTHER PUBLICATIONS

Technical Information http://www.salice.comsalicefilepublic_adminLapis_Ed02_07-2013_ENG.pdf Jul. 2013.

(Continued)

*Primary Examiner* — Jeffrey O Brien
(74) *Attorney, Agent, or Firm* — Schultz & Associates, P.C.

(57) ABSTRACT

A hinge cover assembly for a pre-mounted hinge includes a cup cover releasably connected to a hinge cup of the pre-mounted hinge, an arm cover removably connected to a hinge arm of the pre-mounted hinge, the hinge arm pivotally connected to the hinge cup, and a hinge cover pivotally connected to the cup cover and slidably engaged with the arm cover. The hinge cover is pivotally connected to the hinge cup with a set of pins and a set of torsion springs. The set of torsion springs bias the hinge cover against the arm cover. As the hinge cup is pivoted between an open position and a closed position, the bias of the set of torsion springs and the slidable engagement of the hinge cover with the arm cover enables the hinge cover to extend and retract with respect to the hinge arm and cover the pre-mounted hinge.

24 Claims, 9 Drawing Sheets

(56) References Cited

U.S. PATENT DOCUMENTS

| | | | | |
|---|---|---|---|---|
| D348,201 | S | 6/1994 | Ferrari | |
| 5,975,663 | A | 11/1999 | Becker | |
| 6,152,554 | A | 11/2000 | Parisi | |
| 6,308,376 | B1 * | 10/2001 | Koshikawa | E05D 3/16 16/250 |
| D451,000 | S | 11/2001 | Karl | |
| 6,721,992 | B2 | 4/2004 | Cotton | |
| 6,883,205 | B2 * | 4/2005 | Martinez-Munoz | E05D 11/0054 16/250 |
| D587,562 | S | 3/2009 | Fernandez | |
| D637,065 | S | 5/2011 | Krietzman et al. | |
| D637,066 | S | 5/2011 | Krietzman et al. | |
| 8,011,064 | B2 | 9/2011 | Leimkuehler et al. | |
| 8,020,253 | B1 | 9/2011 | Finkelstein et al. | |
| 8,272,104 | B2 | 9/2012 | Chen et al. | |
| D676,307 | S | 2/2013 | Oshima | |
| D676,308 | S | 2/2013 | Oshima | |
| D684,839 | S | 6/2013 | Oshima | |
| 8,978,205 | B2 * | 3/2015 | Kim | E05D 11/0054 16/251 |
| 2004/0205935 | A1 * | 10/2004 | Lautenschlaeger | E05D 3/142 16/374 |
| 2007/0084017 | A1 * | 4/2007 | Takamatsu | E05D 5/08 16/382 |
| 2014/0026361 | A1 * | 1/2014 | Kim | E05D 11/0054 16/251 |

FOREIGN PATENT DOCUMENTS

| | | | |
|---|---|---|---|
| DE | 2658831 | A1 | 6/1978 |
| DE | 102008016127 | A1 | 10/2009 |
| DE | 102008016127 | B4 | 7/2010 |
| DM | 072574 | | 11/2009 |
| DM | 076112 | | 5/2011 |
| EP | 1103685 | | 5/2001 |
| WO | WO2012141479 | * | 10/2012 |

OTHER PUBLICATIONS

Brochure http://www.salice.com/salice/file/public_admin/Lapis_Emotion_int.pdf [undated].

* cited by examiner

HINGE COVER AND METHOD OF USE

FIELD OF THE INVENTION

The present invention relates to cabinetry hardware. In particular, the invention relates to a long-arm hinge cover for attachment to a pre-mounted cabinet hinge.

BACKGROUND OF THE INVENTION

Cabinet doors are typically mounted to cabinets using long-arm hinges so as to pivot cabinet doors between an open position and a closed position. A hinge arm of each hinge is mounted to the cabinet carcass with a mounting plate. The mounting plate is fastened to the cabinet carcass and the hinge arm is releasably connected to the mounting plate. A hinge cup, which is pivotally connected to the hinge arm, is mounted to the cabinet door with a set of fasteners. The set of fasteners are normally visible and accessible, particularly for hinges which are located near eye level. However, the heads of fasteners, such as screws, present an unsightly appearance. For example, the screws generally do not match the color of the cabinet or cabinet doors.

The prior art has attempted to address these problems with limited success. For example, U.S. Pat. No. 4,847,948 to Gross, et al. discloses an adjustable hinge and a cover for a hinge arm of the adjustable hinge. The cover overlies an adjusting screw and a fastening screw of the hinge arm. The cover includes protuberances that projects and press fits into a recess of the hinge arm and into a slotted hole of the hinge arm. However, the cover in Gross only covers the hinge arm and does not cover the hinge cup leaving the hinge cup fastener heads exposed.

U.S. Pat. No. 4,870,716 to Grass discloses a covering element for a furniture hinge. The covering element has a generally U-shaped cross section and is mounted to a hinge arm of the furniture hinge. The hinge cup is not covered. The covering element snap fits to the sides of the hinge arm to further secure the covering element to the hinge arm. The covering element has an end portion to cover an end of the hinge arm. However, the covering element does not cover the hinge cup.

U.S. Pat. No. 5,056,192 to Grass discloses a protective cover for a hinge. The protective cover is an elastic strip that hooks to an end of the hinge arm, extends to cover the hinge arm, linkage, a portion of the hinge cup, and hooks to the edge of the hinge cup. However, the elastic strip does not cover the fastener portions of the hinge cup. The elastic strip of Grass leaves the fastener heads exposed.

The prior art does not disclose or suggest a hinge cover that covers the entire hinge. Therefore, there is a need in the prior art for a hinge cover that attaches to a pre-mounted hinge and covers the hinge arm and the hinge cup.

SUMMARY

In a preferred embodiment, a hinge cover assembly for a pre-mounted hinge is disclosed. The pre-mounted hinge includes a hinge arm mounted to a cabinet carcass and a hinge cup pivotally connected to the hinge arm and mounted to a cabinet door. The cover assembly includes a cup cover releasably connected to the hinge cup of the pre-mounted hinge, an arm cover removably connected to the hinge arm of the pre-mounted hinge, and a hinge cover pivotally connected to the cup cover and slidably engaged with the arm cover.

The hinge cover is pivotally mounted to the cup cover with a set of pins inserted through the hinge cover and the cup cover, and a set of torsion springs supported by the set of pins. The set of torsion springs biases the hinge cover against the arm cover. In use, as the hinge cup pivots, the bias of the set of torsion springs and the slidable engagement of the hinge cover with the arm cover enables the hinge cover to extend and retract with respect to the hinge arm and cover the entirety of the pre-mounted hinge.

In another embodiment, a high density rare earth magnet is positioned on the arm cover and engages the hinge cover to provide an attractive force between the two and allow the cover to function with or without torsion springs.

BRIEF DESCRIPTION OF THE DRAWINGS

The disclosed embodiments will be described with reference to the accompanying drawings. Like parts in different drawings carry the same number.

DETAILED DESCRIPTION

Figure 1A:
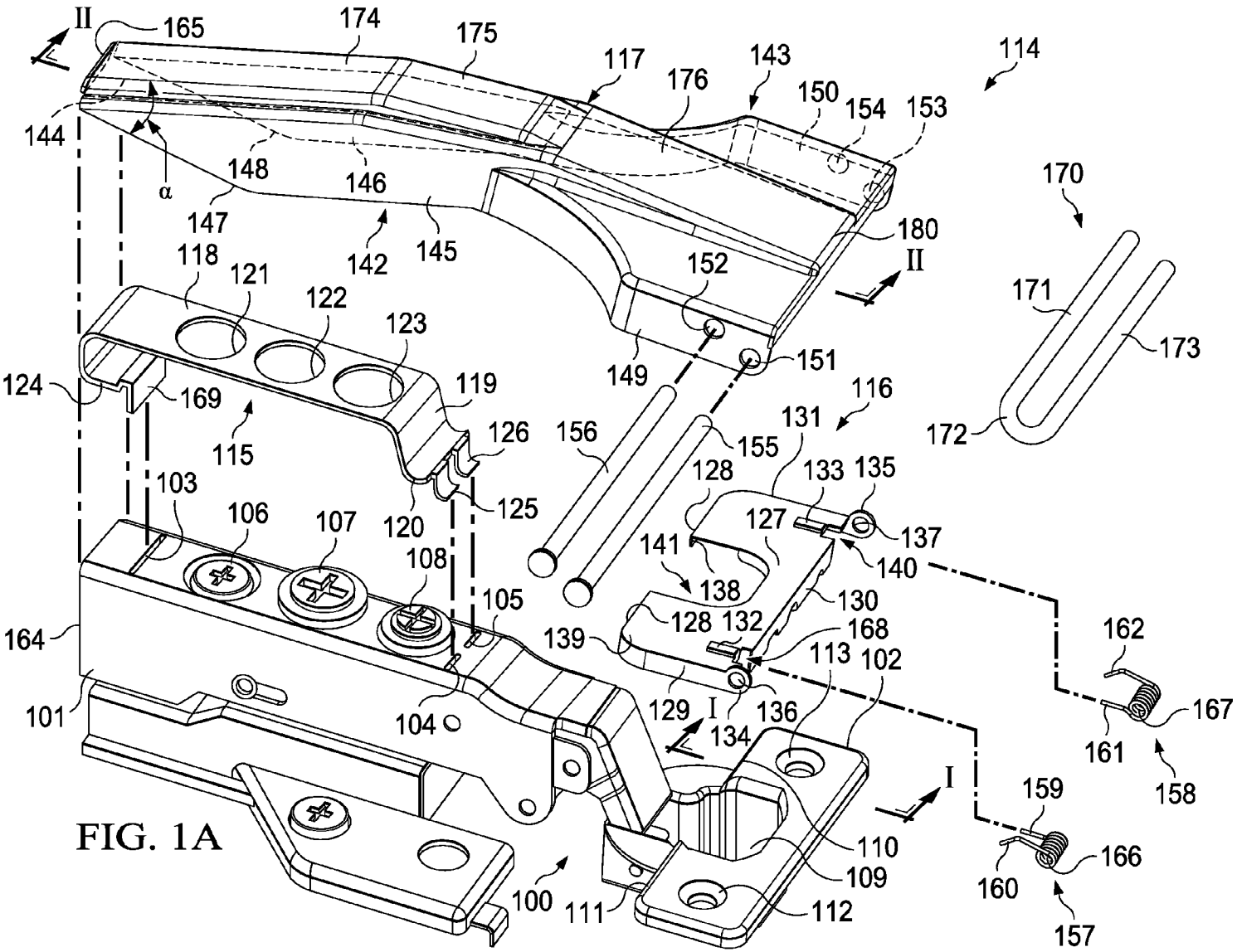
FIG. 1A is an exploded isometric view of a hinge cover assembly of a preferred embodiment.

Referring to FIG. 1A, hinge 100 includes hinge arm 101 and hinge cup 102 pivotally connected to hinge arm 101. Hinge arm 101 has slots 103, 104, and 105 and adjustment fasteners 106, 107, and 108 and end 164. Hinge cup 102 has well 109, slots 110 and 111, and fastener holes 112 and 113.

Hinge cover assembly 114 includes arm cover 115 removably connected to hinge arm 101, cup cover 116 releasably connected to hinge cup 102, and hinge cover 117 pivotally connected to cup cover 116 and slidably engaged with arm cover 115.

Arm cover 115 has body 118, transition plate 119 attached to body 118, and base 120 attached to transition plate 119. Body 118 has access holes 121, 122, and 123 to provide access to adjustment fasteners 106, 107, and 108, respectively, to adjust the position of hinge 100. Other numbers of access holes are envisioned to accommodate different numbers and types of fasteners. Support 124 is attached to body 118. Support 124 includes hook 169. Hooks 125 and 126 are attached to base 120. Hook 169 of support 124 inserts into slot 103. Hooks 125 and 126 insert into slots 104 and 105, respectively. Support 124 and transition plate 119 position body 118 generally parallel to hinge arm 101.

In one embodiment, hooks 125, 126, and 169 are eliminated from arm cover 115. In this embodiment, arm cover 115 is attached to hinge arm 101 with a suitable adhesive. In another embodiment, arm cover 115 is attached to hinge arm 101 with a suitable welding means known in the art. Other suitable means of attachment known in the art may be employed.

In preferred embodiment, arm cover 115 is made of a stamped metal alloy. In one embodiment, arm cover 115 is made of a ferromagnetic material. In another embodiment, stainless steel or cast metal alloy can be employed. In another embodiment, arm cover 115 is made of durable plastic, such as PVC, vinyl or Delrin®. Other durable materials known in the art may be employed.

Cup cover 116 includes surface 127 and sides 128, 129, 130, and 131 integrally formed with surface 127. Slots 132 and 133 are attached to surface 127. Sides 129 and 131 have extensions 134 and 135, respectively. Extension 134 has hole 136. Extension 135 has hole 137. Side 128 has protrusions 138 and 139 that releasably engage with slots 110 and 111, respectively, as will be further described below. Cup cover 116 covers fastener holes 112 and 113 of hinge cup 102 and fasteners when installed. Gap 168 is integrally formed into surface 127 and side 130, adjacent to extension 134 and slot 132. Gap 140 is integrally formed into surface 127 and side 130 adjacent to extension 135 and slot 133. Well gap 141 is integrally formed into surface 127 and side 128 to provide access to well 109 of hinge cup 102.

In one embodiment, protrusions 138 and 139 are eliminated from cup cover 116. In this embodiment, slots 110 and 111 of hinge cup 102 are eliminated. In one embodiment, cup cover 116 is connected to hinge cup 102 with a suitable welding means. In another embodiment, arm cover is connected to hinge cup 102 with a suitable adhesive. Other suitable means of attachment known in the art may be employed.

In preferred embodiment, cup cover 116 is made of a metal alloy. In this embodiment, each of slots 132 and 133 are stamped into surface 127. In another embodiment, slots 132 and 133 are attached to surface 127 with a suitable welding means known in the art.

In another embodiment, cup cover 116 is made of plastic. In other embodiments, other durable materials known in the art are employed.

Hinge cover 117 includes arm portion 142 and cup portion 143 integrally formed with arm portion 142, and inside surface 144. Top surface 180 includes angled faces 174, 175, and 176. Arm portion 142 includes end 165 adjacent angled face 174 and faces 145 and 146 attached to angled faces 174 and 175. Face 145 has taper 147 and face 146 has taper 148. Tapers 147 and 148 prevent damage to a cabinet carcass adjacent to hinge cover 117 when in use and enable hinge cover 117 to translate with respect to hinge 100 as hinge cup 102 pivots, as will be further described below. Tapers 147 and 148 of faces 145 and 146, respectively, are tapered at angle $\alpha$ from inside surface 144.

In a preferred embodiment, angle $\alpha$ is a range of about 0° to about 90°. Other angles may be employed.

Cup portion 143 has sides 149 and 150. Side 149 has holes 151 and 152. Side 150 has holes 153 and 154. Holes 151 and 153 are axially aligned with respect to each other. Holes 152 and 154 are axially aligned.

In a preferred embodiment, hinge cover 117 is made of a metal alloy. In one embodiment, hinge cover 117 is made of a ferromagnetic material. In another embodiment, hinge cover 117 is made of plastic. Other durable materials known in the art may be employed.

Hinge cover 117 is pivotally attached to cup cover 116 with pins 155 and 156 and torsion springs 157 and 158. Pin 155 is inserted through hole 151 of hinge cover 117, hole 136 of extension 134, torsion springs 157 and 158, hole 137 of extension 135, and hole 153 of hinge cover 117. Pin 156 is inserted through holes 152 and 154. Hinge cover 117 pivots about pin 155, as will be further described below.

Torsion spring 157 has spring arms 159 and 160 and hole 166 sized to receive pin 155. Torsion spring 158 has spring arms 161 and 162 and hole 167 sized to receive pin 155. Spring arms 159 and 161 insert into slots 132 and 133 of cup cover 116, respectively. Spring arms 160 and 162 are adjacent to pin 156 to secure torsion springs 157 and 158. Torsion springs 157 and 158 bias hinge cover 117 against arm cover 115, as will be further described below.

In a preferred embodiment, each of pins 155 and 156 is made of a metal alloy. In another embodiment, each of pins 155 and 156 is made of plastic. Other durable materials known in the art may be employed.

In one embodiment, pin 170 may replace pins 155 and 156. Pin 170 has a generally "U" shape and includes straight portions 171 and 173, and curved portion 172. In this embodiment, straight portion 171 replaces pin 156 and straight portion 173 replaces pin 155.

In a preferred embodiment, each of torsion springs 157 and 158 is made of a metal alloy. In another embodiment, each of torsion springs 157 and 158 is made of plastic. Other durable materials known in the art may be employed.

In a preferred embodiment, each of torsion springs 157 and 158 has a torsion spring constant of approximately a 3 lbs.-inch/radian. In other embodiments, spring constants of between about 0.5 lbs.-inch/radian and 10 lbs.-inch/radian are employed.

Figure 1B:
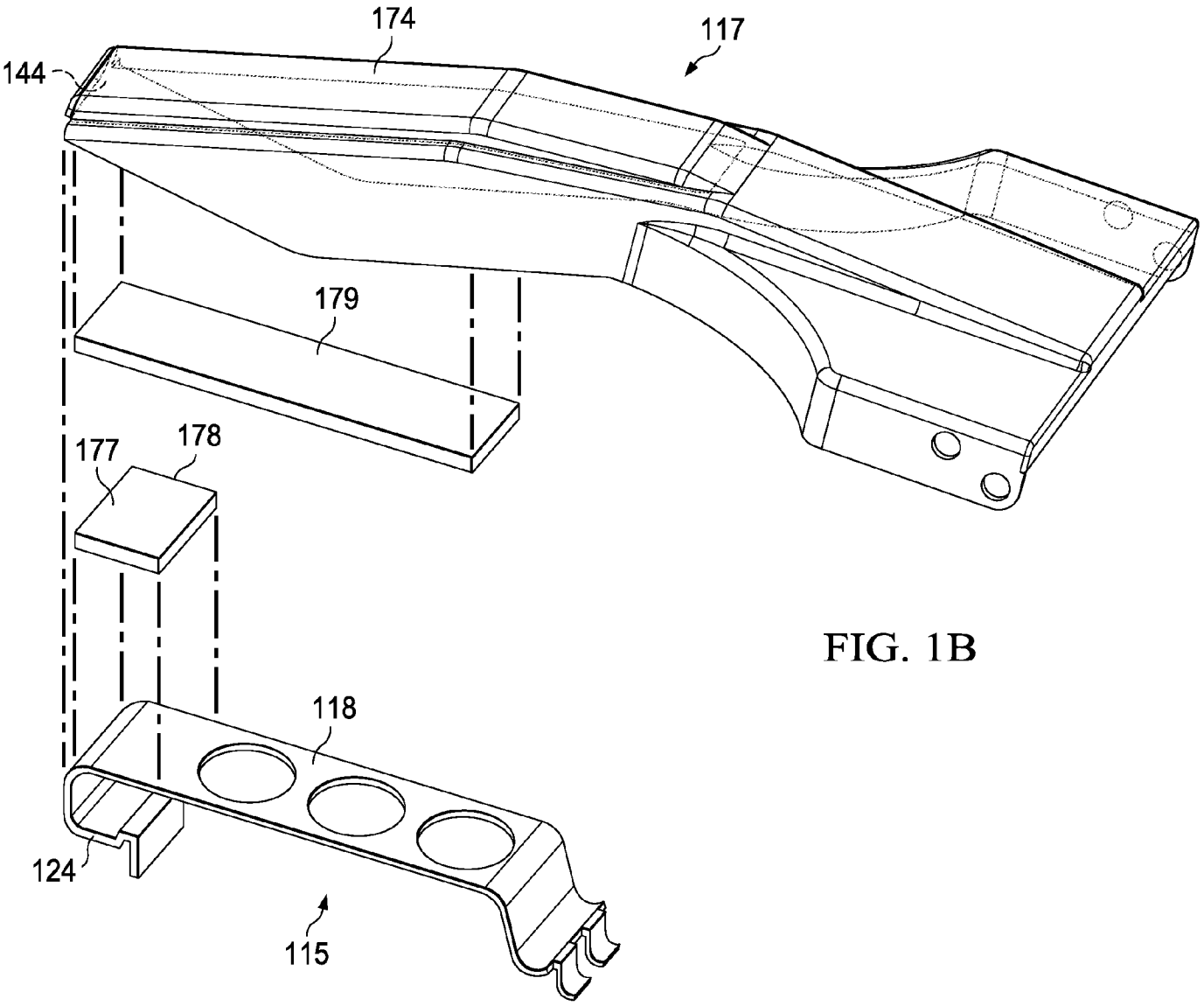
FIG. 1B is an exploded isometric view of a hinge cover assembly of a preferred embodiment.

Referring to FIG. 1B in another embodiment, magnet 177 is attached to body 118 of arm cover 115 opposite support 124. Hinge cover 117 is made of a ferromagnetic material. Magnet 177 includes exterior coating 178 to reduce friction between magnet 177 and inside surface 144 of hinge cover 117. Magnet 177 draws hinge cover 117 towards arm cover 115 and maintains hinge cover 117 in contact with magnet 177.

In a preferred embodiment, magnet 177 is made of neodymium. In another embodiment, magnet 177 is made of samarium-cobalt. Other ferromagnetic materials, including rare-earth magnetic materials may be employed.

In a preferred embodiment, magnet 177 has a holding force of approximately 8 lbs. Other holding forces may be employed.

In one embodiment, exterior coating 178 is Teflon®. In another embodiment, exterior coating 178 is Delrin®. Other friction reducing coatings known in the art may be employed.

In another embodiment, magnetic strip 179 is attached to inside surface 144 of angled face 174. In this embodiment, hinge cover 117 is made of a non-ferromagnetic material. In this embodiment, arm cover 115 is made of a ferromagnetic material. Magnetic strip 179 biases arm cover 115 towards hinge cover 117 and maintains magnetic strip 179 in contact with arm cover 115.

In a preferred embodiment, magnetic strip 179 is a flexible magnetic strip having a holding force of approximately 8 lbs. available from Industrial Magnetics, Inc. of Boyne City, Mich. In other embodiments, other holding forces are employed. Other magnetic strips known in the art may be employed.

Figure 2:
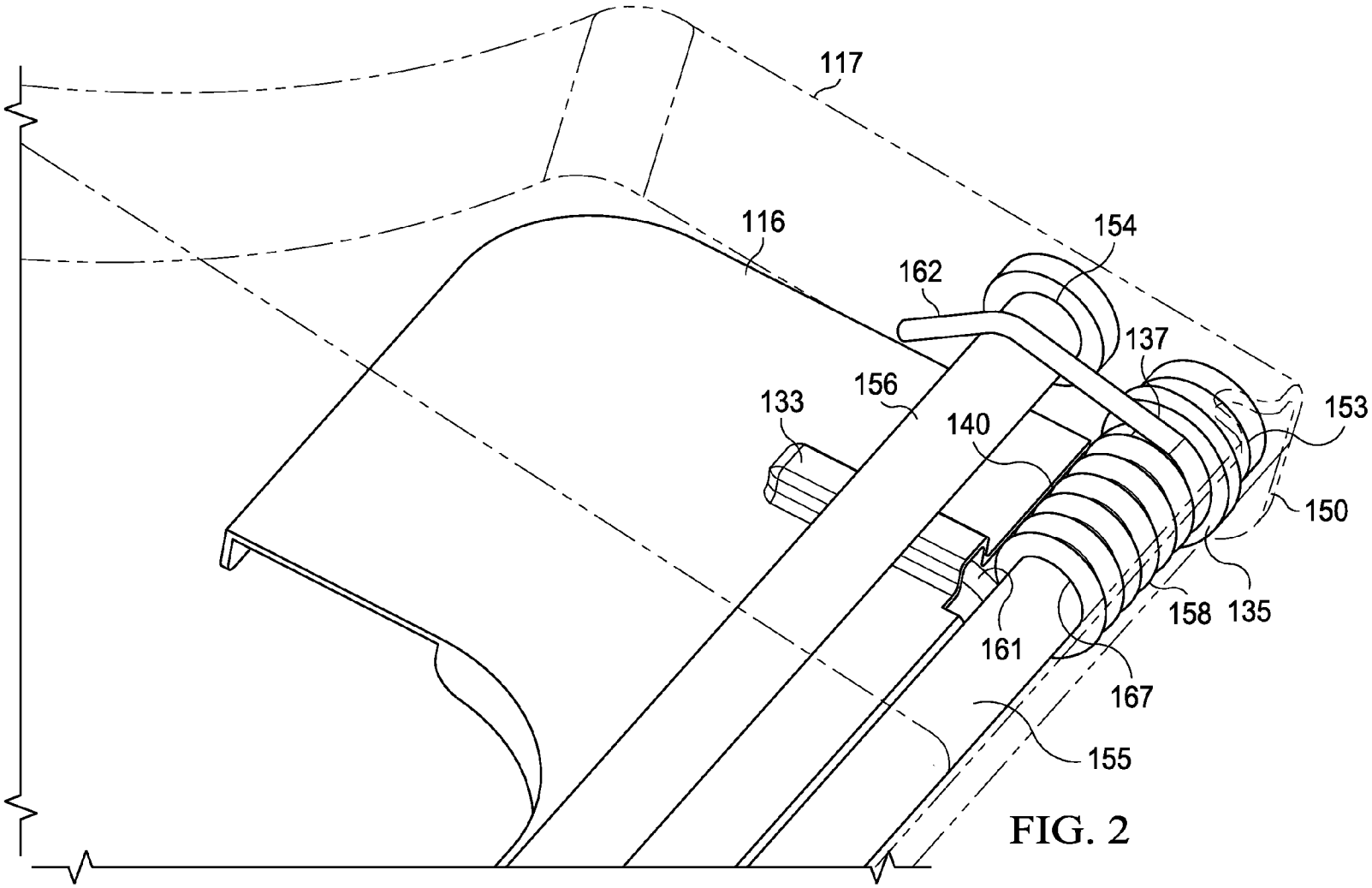
FIG. 2 is a detail isometric view of a pivotal attachment for a hinge cover assembly of a preferred embodiment.

Referring to FIG. 2, pin 155 is inserted through hole 167 of torsion spring 158, hole 137 of extension 135, and hole 153 of hinge cover 117. Spring arm 161 of torsion spring 158 is inserted through gap 140 and into slot 133 of cup cover 116. Pin 156 is inserted through hole 154 of hinge cover 117. Spring arm 162 is adjacent to pin 156. Spring arm 161 is adjacent to pin 156, opposite spring arm 162. Torsion spring 158 biases hinge cover 117 towards cup cover 116.

Figure 3:
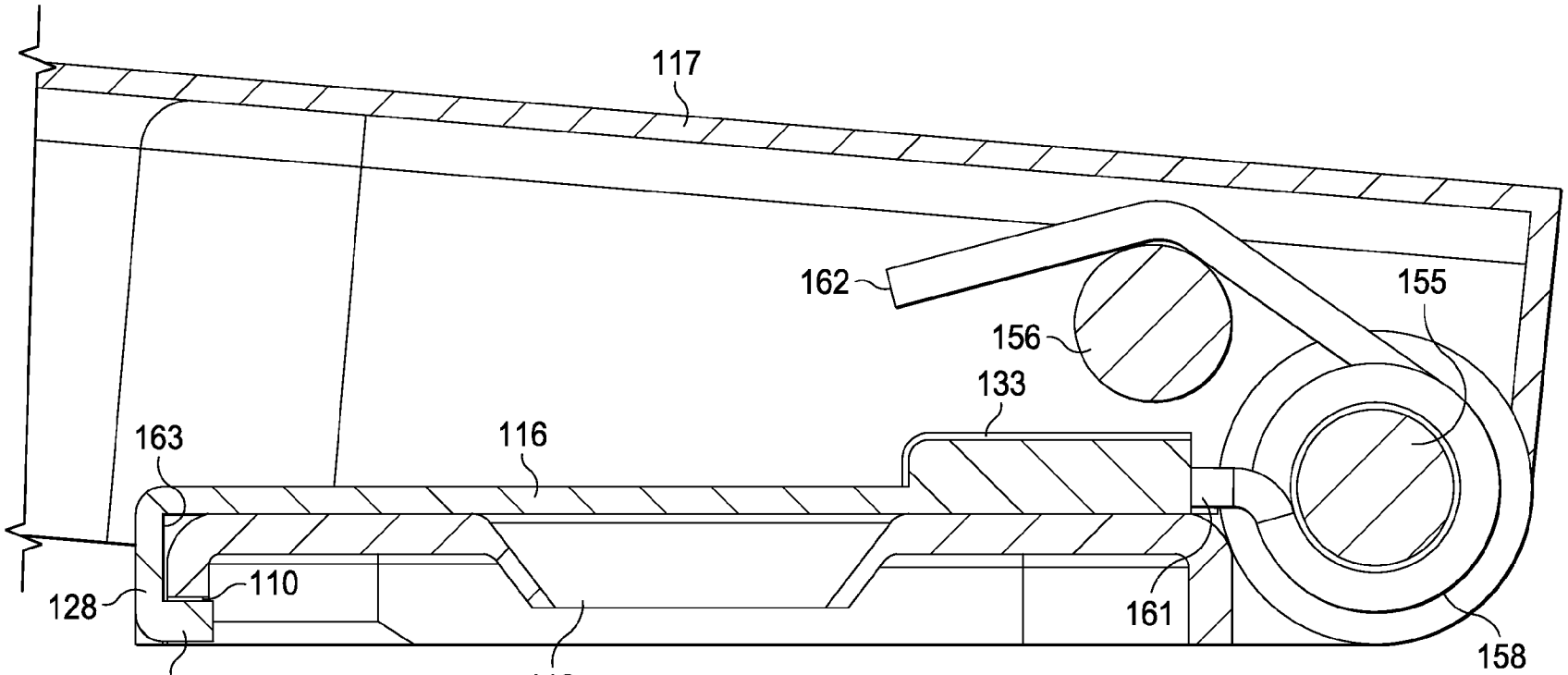
FIG. 3 is a partial section view of a hinge cup and a cup cover of a preferred embodiment along line I-I of FIG. 1.

Referring to FIG. 3, protrusion 138 is attached to inside surface 163 of side 128. Protrusion 138 is positioned in slot 110 of hinge cup 102 to releasably secure cup cover 116 to hinge cup 102 with a snap fit. In one embodiment, a suitable adhesive may be employed to releasably secure cup cover 116 to hinge cup 102.

Figure 4A:
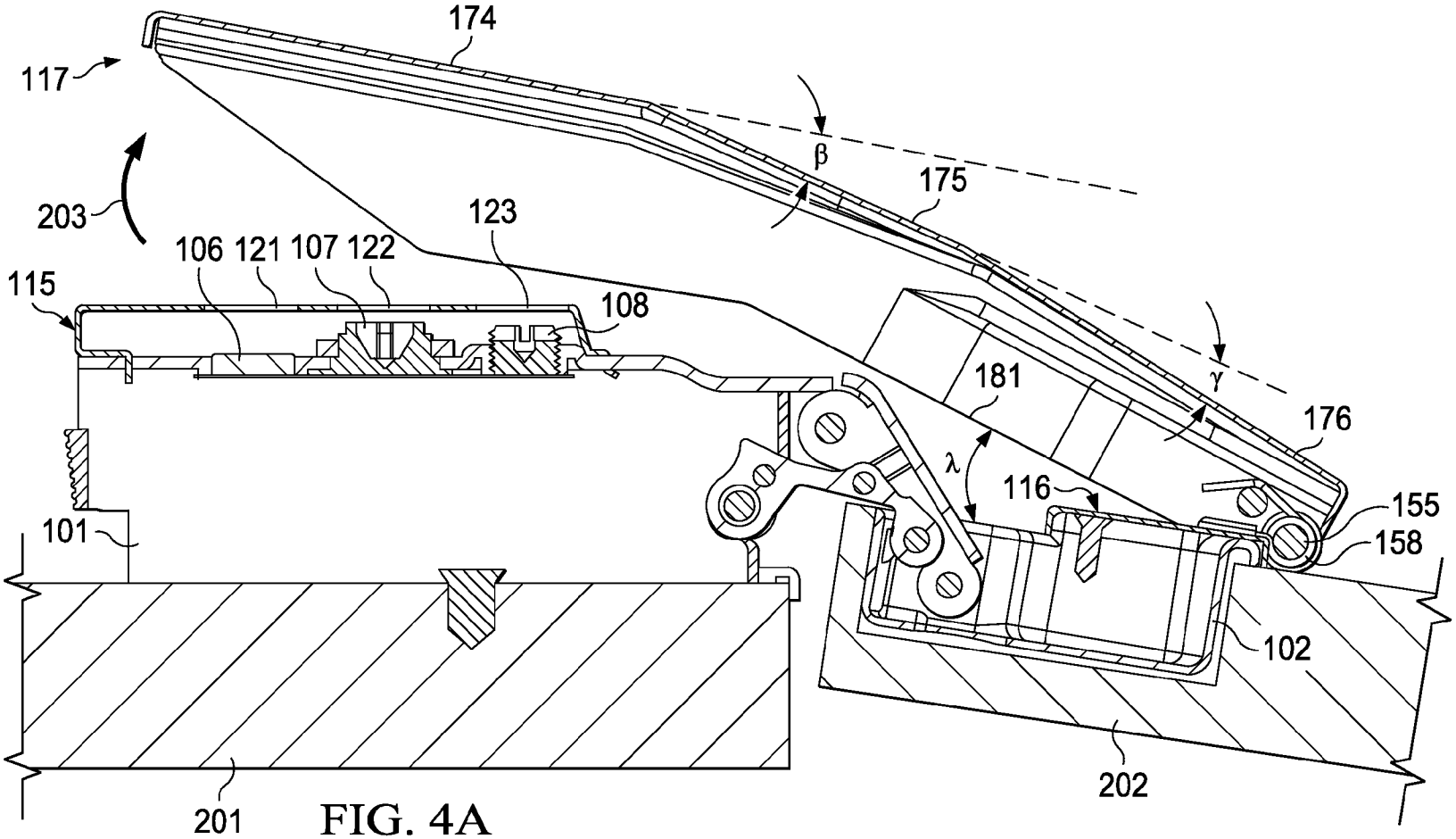
FIG. 4A is a partial section view along line II-II of FIG. 1A of a hinge cover in an open position and a hinge in an open position of a preferred embodiment.

Referring to FIG. 4A, in use, hinge arm 101 is secured to cabinet carcass 201 with a first set of fasteners. Hinge cup 102 is secured to cabinet door 202 with a second set of fasteners. Arm cover 115 is removably connected to hinge arm 101, cup cover 116 is releasably connected hinge cup 102, and hinge cover 117 is pivotally connected to cup cover 116. Angled face 175 is offset at angle β with respect to angled face 174. Angled face 176 is offset at angle γ with respect to angled face 175.

In a preferred embodiment, angle β is approximately 15°. Other angles may be employed.

In a preferred embodiment, angle β is approximately 5°. Other angles may be employed.

In use, torsion spring 158 biases hinge cover 117 against body 118 of arm cover 115. Hinge cover 117 pivots about pin 155 in direction 203 through angle λ against the bias of torsion spring 158 to provide access to adjustment fasteners 106, 107, and 108 of hinge arm 101 through access holes 121, 122, and 123 of arm cover 115, respectively. Adjustment fasteners 106, 107, and 108 may be adjusted with a suitable tool, such as a screwdriver to adjust the position of hinge 100. Angle λ separates edge 181 of hinge cover 117 and hinge cup 102.

In one embodiment, angle is approximately 20°. Other angles may be employed.

Figure 4B:
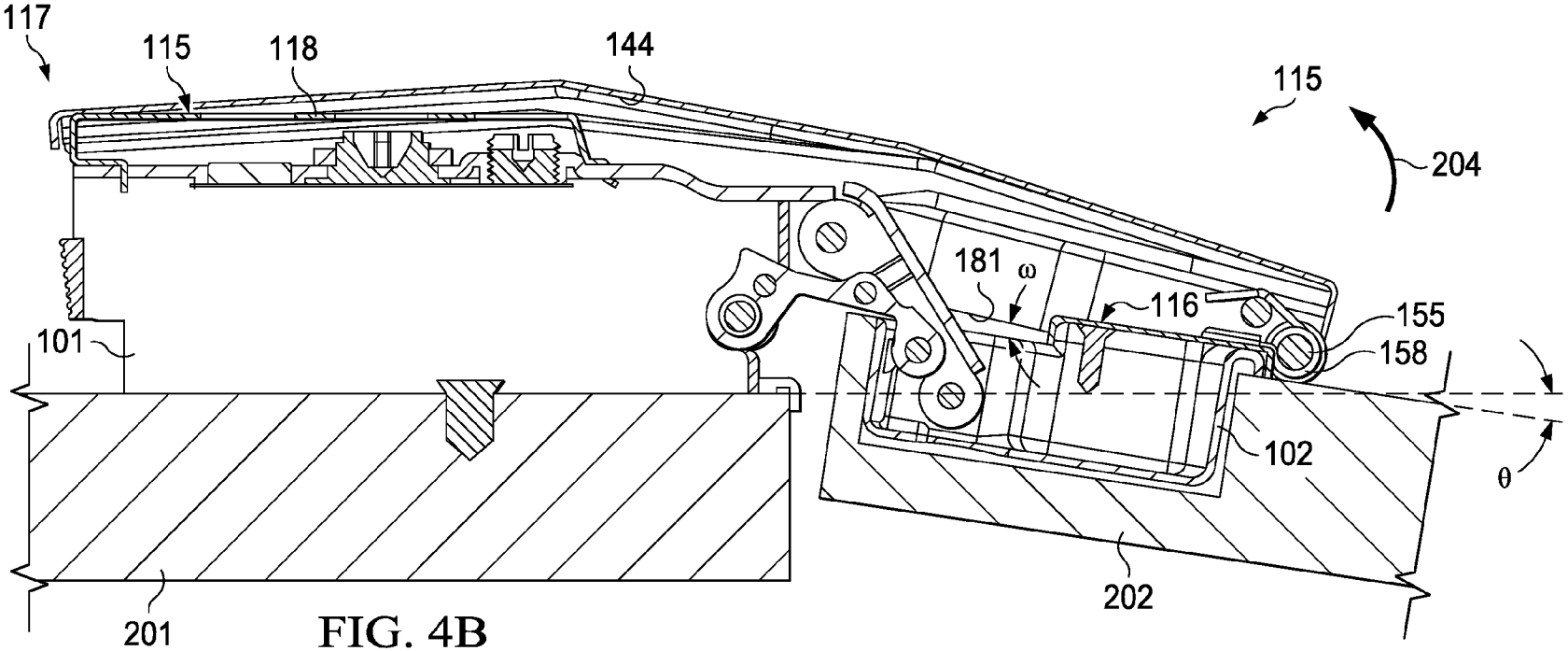
FIG. 4B is a partial section view along line II-II of FIG. 1A of a hinge cover in a closed position and a hinge in an open position of a preferred embodiment.

Referring to FIG. 4B, hinge cover 117 is in a closed position. Inside surface 144 of hinge cover 117 is adjacent to body 118 of arm cover 115 as previously described covering the entirety of hinge arm 101 and hinge cup 102. Cabinet door 202 is in an open position. Angle ω separates edge 181 of hinge cover 117 and hinge cup 102. Angle θ separates hinge cup 102 and cabinet carcass 201. Cabinet door 202 and hinge cup 102 pivot in direction 204 to close cabinet door 202. Angle ω and angle θ increase as cabinet door 202 and hinge cup 102 pivot in direction 204.

Figure 4C:
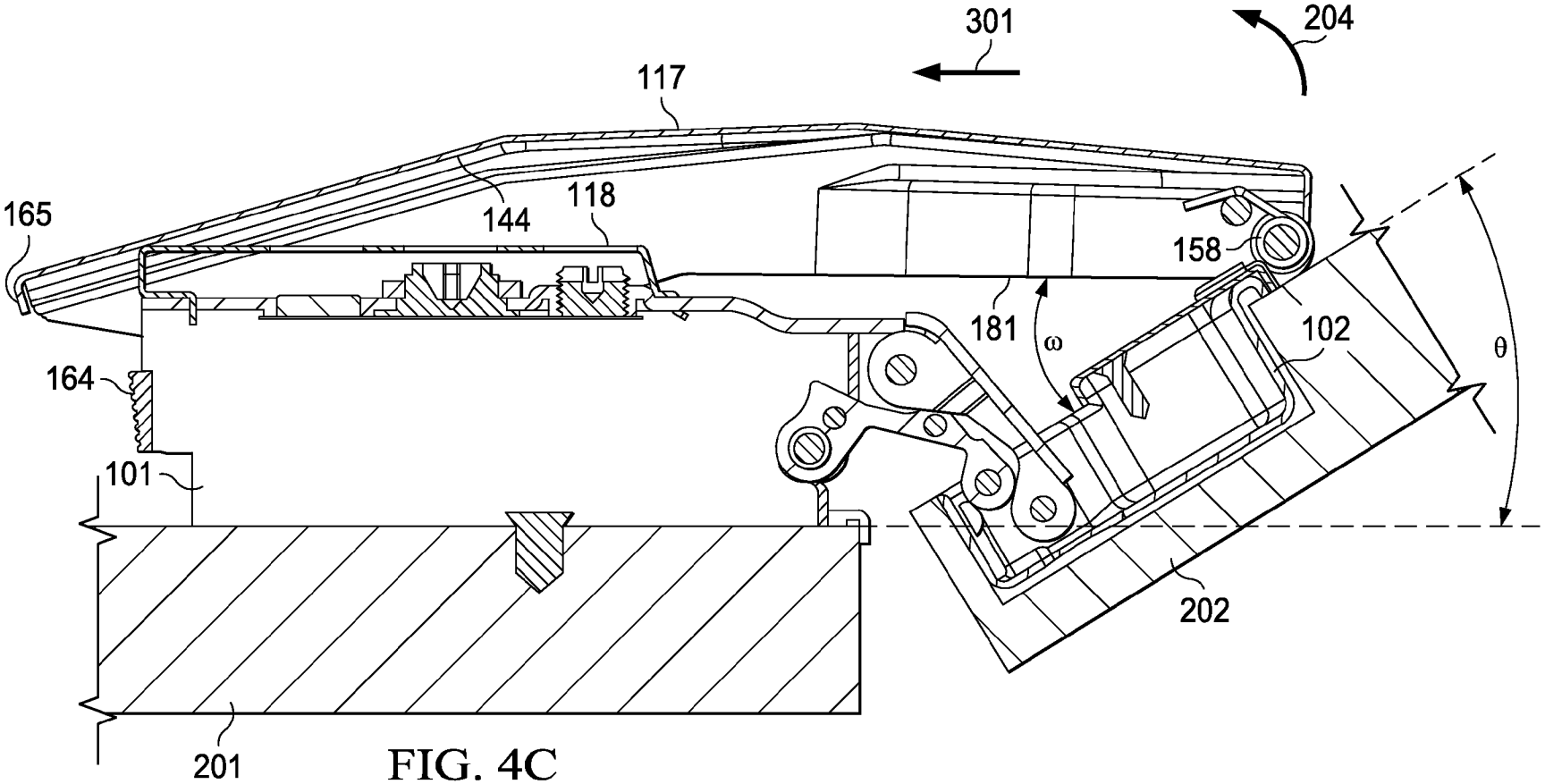
FIG. 4C is a partial section view along line II-II of FIG. 1A of a hinge cover and a hinge in a 30° partial open position of a preferred embodiment.

Referring to FIG. 4C, cabinet door 202 and hinge cup 102 are shown advanced in direction 204 from the open position to a 30° partial open position. As cabinet door 202 and hinge cup 102 pivot in direction 204, torsion spring 158 biases hinge cover 117 against body 118 and inside surface 144 of hinge cover 117 slidably engages with body 118 to translate hinge cover 117 in direction 301 extending end 165 of hinge cover 117 away from end 164 of hinge arm 101. Angle θ is approximately 30°. Angle co is approximately 30°.

Figure 4D:
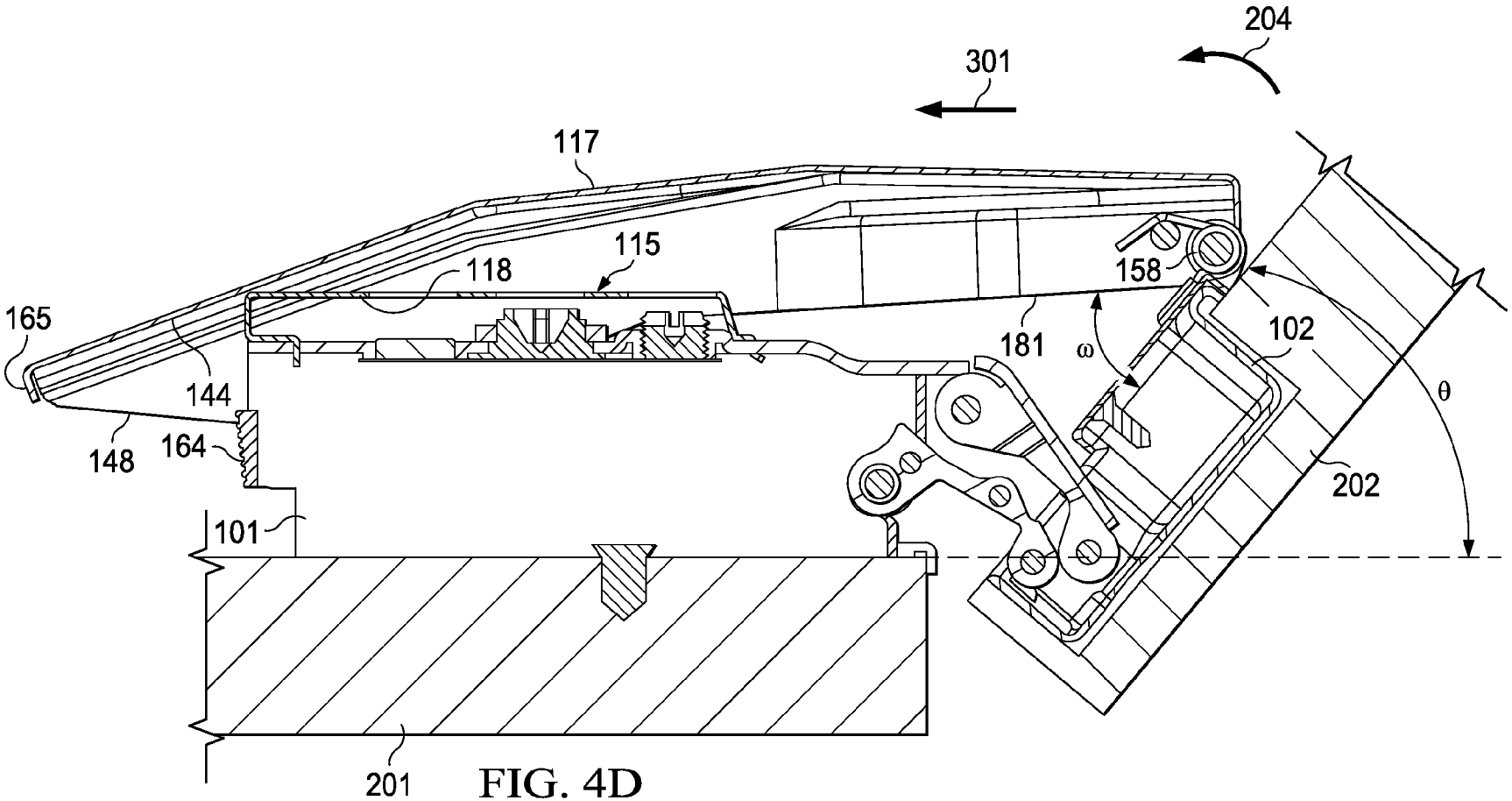
FIG. 4D is a partial section view along line II-II of FIG. 1A of a hinge cover and a hinge in a 60° partial closed position of a preferred embodiment.

Referring to FIG. 4D, cabinet door 202 and hinge cup 102 are shown advanced in direction 204 from the 30° partial open position to a 60° partial open position. As cabinet door 202 and hinge cup 102 pivot in direction 204, torsion spring 158 biases hinge cover 117 against body 118 of arm cover 115 and inside surface 144 of hinge cover 117 slidably engages with body 118 to translate hinge cover 117 in direction 301 further extending end 165 of hinge cover 117 away from end 164 of hinge arm 101. Taper 148 enables inside surface 144 to maintain contact and slidable engagement with body 118 and prevents hinge cover 117 from contacting cabinet carcass 201. Angle θ is approximately 60°. Angle ω is approximately 60°.

Figure 4E:
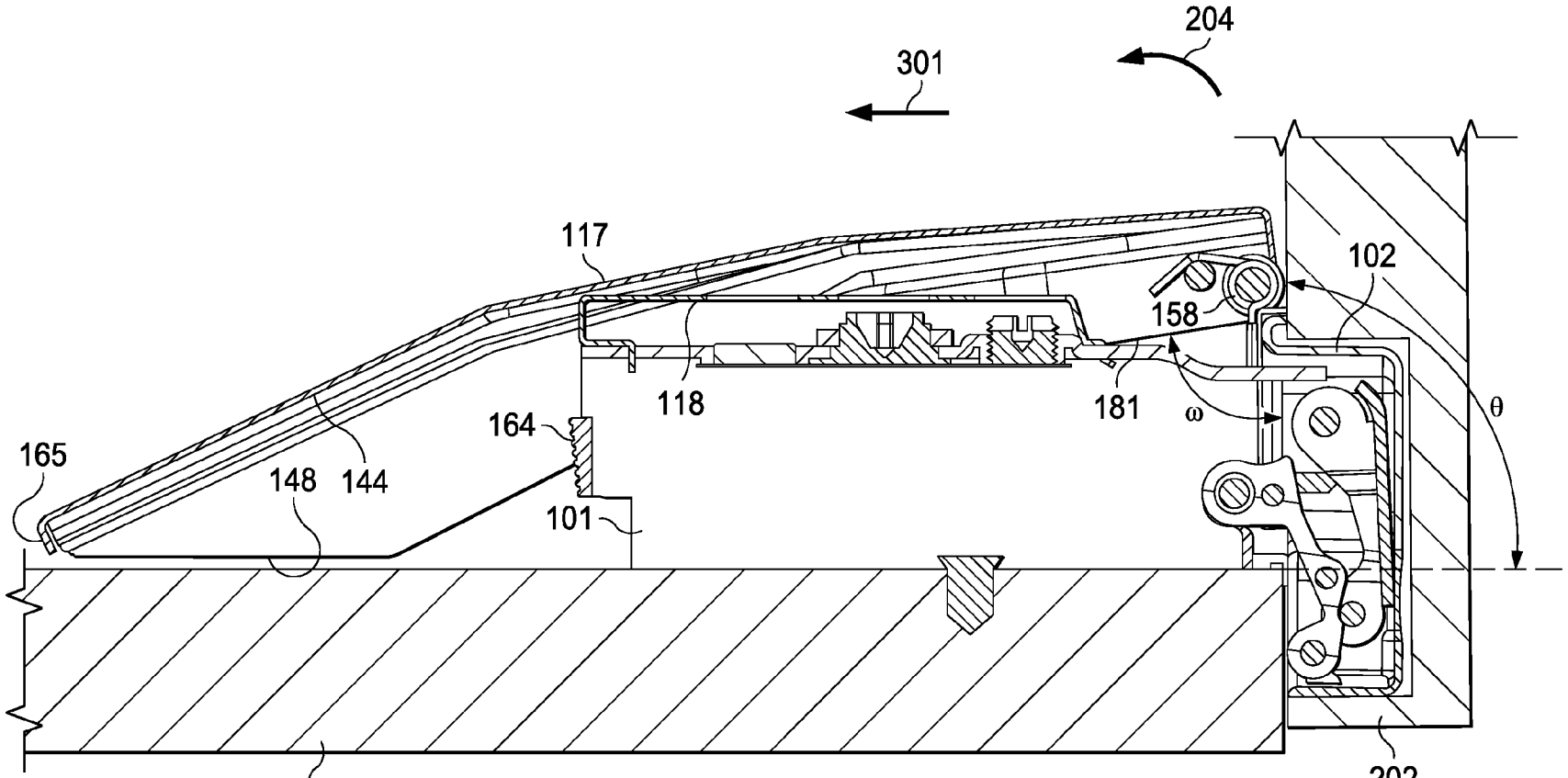
FIG. 4E is a partial section view along line II-II of FIG. 1A of a hinge cover and a hinge in a closed position of a preferred embodiment.

Referring to FIG. 4E, cabinet door 202 and hinge cup 102 are shown advanced in direction 204 from the 60° partial open position to a closed position. As cabinet door 202 and hinge cup 102 pivot in direction 204, torsion spring 158 biases hinge cover 117 against body 118 and inside surface 144 of hinge cover 117 slidably engages with body 118 to translate hinge cover 117 in direction 301. Cabinet door 202 is adjacent to and generally perpendicular to cabinet carcass 201. The bias of torsion spring 158 maintains inside surface 144 of hinge cover 117 in contact with body 118 when cabinet door 202 is in the closed position. End 165 of hinge cover 117 is in a fully extended position away from end 164 of hinge arm 101. Taper 148 is generally parallel to cabinet carcass 201. Hinge cover 117 covers hinge arm 101 and hinge cup 102. Angle θ is approximately 90°. Angle ω is approximately 90°.

It will be appreciated by those skilled in the art that cabinet door 202 and hinge cup 102 may be moved in a direction opposite of direction 204 to open cabinet door 202, retreating hinge cover 117, and thereby reversing the order of positions described in FIGS. 4B, 4C, 4D, and 4E.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A cover assembly for a hinge, the hinge having a hinge arm pivotally connected to a hinge cup and capable of moving between an open position and a closed position, the cover assembly comprising:

a cup cover;

a hinge cover, pivotally connected to the cup cover and configured to be slidably positioned adjacent the hinge;

a bias means, adjacent the hinge cover, for biasing the hinge cover toward the hinge; and, wherein the hinge cover is configured to conceal the hinge arm and the hinge cup when the hinge is in the open position.

2. The cover assembly of claim 1, wherein the hinge further includes a hinge arm and wherein the cover assembly further comprises:

an arm cover, configured to be positioned between the hinge cover and the hinge arm.

3. The cover assembly of claim 2, wherein the bias means further comprises a magnetic strip, attached to the hinge cover, biasing the hinge cover with respect to the arm cover.

4. The cover assembly of claim 1, wherein the bias means further comprises:

a torsion spring biasing the hinge cover with respect to the cup cover.

5. The cover assembly of claim 4, wherein the torsion spring has a torsion spring constant in a range of about 0.5 lbs.-inch/radian and 10 lbs.-inch/radian.

6. The cover assembly of claim 1, wherein the bias means further comprises a magnet, configured to be positioned between the hinge cover and the hinge.

7. The cover assembly of claim 1, wherein the hinge cover further comprises a top surface, the top surface consisting essentially of a first angled face and a second angled face.

8. The cover assembly of claim 2, wherein the arm cover further comprises a set of access holes.

9. The cover assembly of claim 2, wherein the arm cover is configured to be releasably attached to the hinge arm.

10. A cover assembly for a long-armed hinge, the long-armed hinge having a hinge arm and a hinge cup pivotally connected to the hinge arm and capable of movement between an open position and a closed position, the cover assembly comprising:

a cup cover, configured to be releasably connected to the hinge cup;

an arm cover, configured to be removably connected to the hinge arm;

a hinge cover, pivotally connected to the cup cover and slidably engaged with the arm cover;

whereby the hinge cover is configured to conceal the arm cover and the cup cover when the hinge is in the open position.

11. The cover assembly of claim 10, further comprising:

a set of torsion springs, positioned between the hinge cover and the arm cover, biasing the hinge cover with respect to the arm cover.

12. The cover assembly of claim 10, wherein the hinge cover further comprises a set of tapered faces.

13. The cover assembly of claim 12, wherein each tapered face of the set of tapered faces is tapered at an angle in a range of about 0° to about 90°.

14. The cover assembly of claim 10, wherein the arm cover further comprises a set of access holes.

15. The cover assembly of claim 10, wherein the cup cover further comprises a set of protrusions configured to be releasably engaged in the set of slots with the hinge cup.

16. The cover assembly of claim 10, further comprising a magnet attached to one of the group of, the arm cover and the hinge cover.

17. The cover assembly of claim 16, further comprising a friction reduction layer adjacent the magnet.

18. A furniture hinge capable of pivoting between an open position and a closed position comprising:

a hinge arm pivotally connected to a hinge cup;

a cup cover releasably connected to the hinge cup;

an arm cover removably connected to the hinge arm;

a hinge cover, pivotally connected to the cup cover and slidably positioned adjacent the arm cover;

a spring connected between the hinge cover and the arm cover; and, wherein the hinge cover conceals the hinge arm and the hinge cup when the hinge is in the open position.

19. The furniture hinge of claim 18, wherein the arm cover is between the hinge cover and the hinge arm.

20. The furniture hinge of claim 18, wherein the spring further comprises:

a torsion spring biasing the hinge cover toward the cup cover.

21. The furniture hinge of claim 18, wherein the spring further comprises:

a magnet positioned between the hinge cover and the arm cover.

22. The furniture hinge of claim 18, wherein the hinge cover further comprises a top surface, the top surface consisting essentially of a first angled face and a second angled face.

23. The furniture hinge of claim 18, wherein the arm cover further comprises a set of access holes.

24. The furniture hinge of claim 18, wherein the hinge arm further comprises a set of slots and wherein the arm cover is retained in the set of slots.

* * * * *